US012685888B1

(12) United States Patent
Theocharides

(10) Patent No.: US 12,685,888 B1
(45) Date of Patent: Jul. 21, 2026

(54) ADAPTABLE FITNESS MACHINE

(71) Applicant: Victor Theocharides, Palm Bay, FL (US)

(72) Inventor: Victor Theocharides, Palm Bay, FL (US)

( * ) Notice: Subject to any disclaimer, the term of this patent is extended or adjusted under 35 U.S.C. 154(b) by 39 days.

(21) Appl. No.: 18/937,585

(22) Filed: Nov. 5, 2024

Related U.S. Application Data

(60) Provisional application No. 63/605,972, filed on Dec. 4, 2023.

(51) Int. Cl.
*A63B 21/00* (2006.01)
*A63B 21/005* (2006.01)

(52) U.S. Cl.
CPC ..... *A63B 21/00069* (2013.01); *A63B 21/005* (2013.01); *A63B 21/151* (2013.01); *A63B 2225/10* (2013.01)

(58) Field of Classification Search
CPC ..... A63B 21/00069; A63B 21/005; A63B 21/151; A63B 2225/10
See application file for complete search history.

(56) References Cited

U.S. PATENT DOCUMENTS 12,502,574 B2 * 12/2025 Smith ..... A63B 21/4035
2015/0182780 A1 * 7/2015 Olson ..... A63B 21/4029 482/92
2019/0076691 A1 * 3/2019 Smith ..... A63B 23/1209
2019/0099637 A1 * 4/2019 Valente ..... A63B 21/0058
2020/0047055 A1 * 2/2020 Ward ..... G06F 3/011
2021/0236874 A1 * 8/2021 Ward ..... A63B 24/0087
2022/0134171 A1 * 5/2022 LoDuca ..... A63B 21/063 482/99
2022/0273985 A1 * 9/2022 Jeong ..... A63B 22/0076
2022/0370854 A1 * 11/2022 Zhang ..... A63B 21/169
2023/0055078 A1 * 2/2023 Malcolm ..... A63B 21/156
2023/0116715 A1 * 4/2023 Powell ..... A63B 21/4047 482/110
2023/0241448 A1 * 8/2023 LoDuca ..... A63B 21/4035 482/99
2023/0277890 A1 * 9/2023 Peal ..... A63B 21/151 482/92
2024/0367005 A1 * 11/2024 Falcone ..... A63B 24/0062
2025/0325878 A1 * 10/2025 Ezran ..... A63B 21/152

* cited by examiner

*Primary Examiner* — Andrew S Lo

(57) ABSTRACT

The adaptable fitness machine is an exercise device configured for use in strength training. The adaptable fitness machine is a programable structure. The adaptable fitness machine generates the resistance necessary for strength training, and is adjustable. The adaptable fitness machine incorporates a pedestal structure, a plurality of resistance structures, and a control circuit. The control circuit and the plurality of resistance structures attach to the pedestal structure. The pedestal structure is a load bearing structure that transfers the load of the adaptable fitness machine to the supporting surface. The plurality of resistance structures provides the resistance generated by the adaptable fitness machine. The control circuit controls the amount of resistance generated by each individual resistance structure selected from the plurality of resistance structures.

14 Claims, 5 Drawing Sheets

ADAPTABLE FITNESS MACHINE

CROSS REFERENCES TO RELATED APPLICATIONS

This non-provisional application claims priority under 35 USC 119(e) to U.S. provisional application 63/605,972 filed on Dec. 4, 2023 by the inventor: Victor Theocharides. This non-provisional application claims U.S. provisional application 63/605,972 in its entirety.

STATEMENT REGARDING FEDERALLY SPONSORED RESEARCH

Not Applicable

REFERENCE TO APPENDIX

Not Applicable

BACKGROUND OF THE INVENTION

Not Applicable

SUMMARY OF INVENTION

The adaptable fitness machine is an exercise device. The adaptable fitness machine is configured for use in strength training. The adaptable fitness machine is a programable structure. The adaptable fitness machine generates the resistance necessary for strength training. The resistance generated by the adaptable fitness machine is adjustable. The adaptable fitness machine comprises a pedestal structure, a plurality of resistance structures, and a control circuit. The control circuit and the plurality of resistance structures attach to the pedestal structure. The pedestal structure is a load bearing structure that transfers the load of the adaptable fitness machine to the supporting surface. The plurality of resistance structures provides the resistance generated by the adaptable fitness machine. The control circuit controls the amount of resistance generated by each individual resistance structure selected from the plurality of resistance structures.

These together with additional objects, features and advantages of the adaptable fitness machine will be readily apparent to those of ordinary skill in the art upon reading the following detailed description of the presently preferred, but nonetheless illustrative, embodiments when taken in conjunction with the accompanying drawings.

In this respect, before explaining the current embodiments of the adaptable fitness machine in detail, it is to be understood that the adaptable fitness machine is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the adaptable fitness machine.

It is therefore important that the claims be regarded as including such equivalent construction insofar as they do not depart from the spirit and scope of the adaptable fitness machine. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
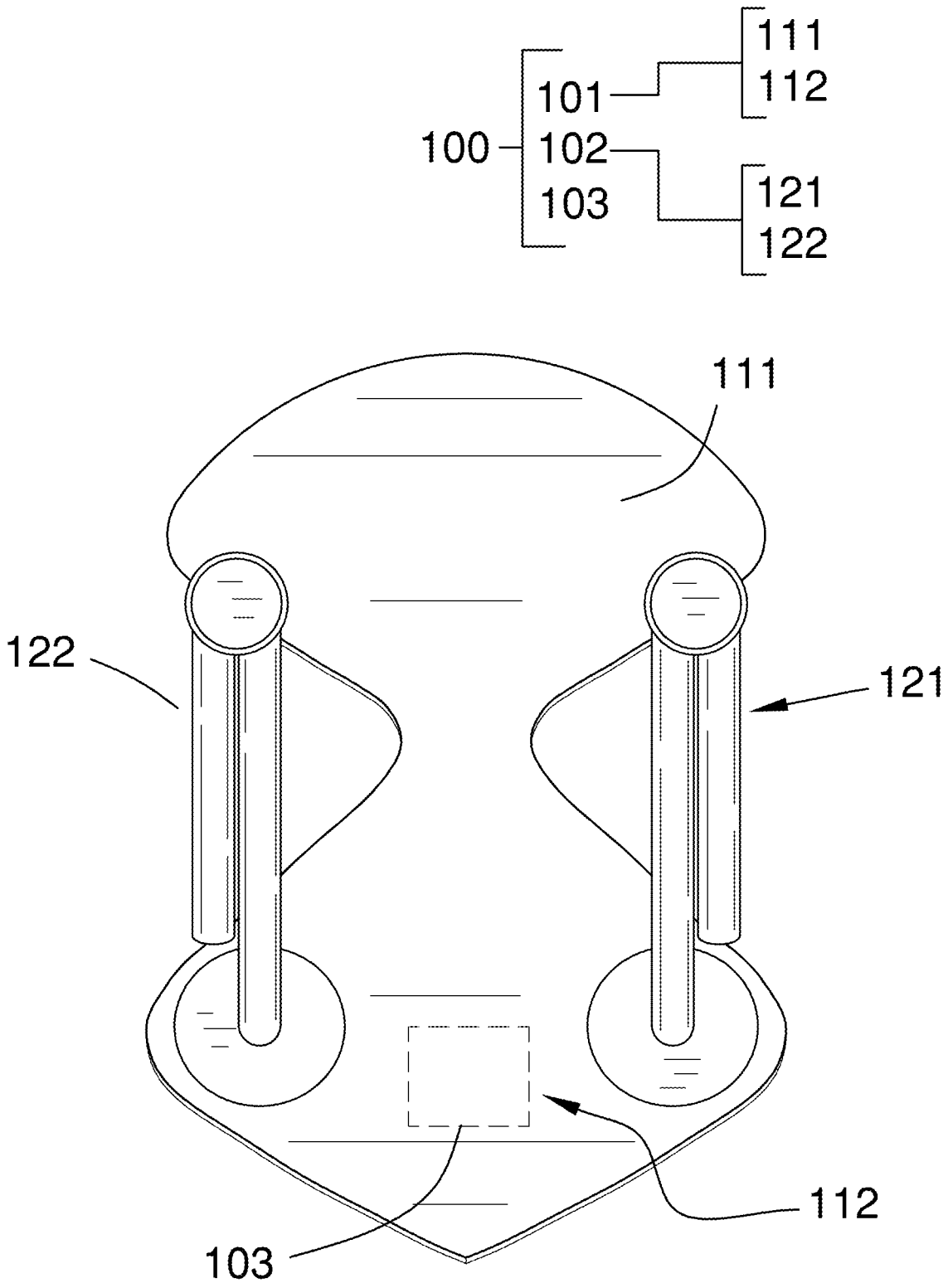
FIG. 1 is a perspective view of an embodiment of the disclosure.
Figure 2A:
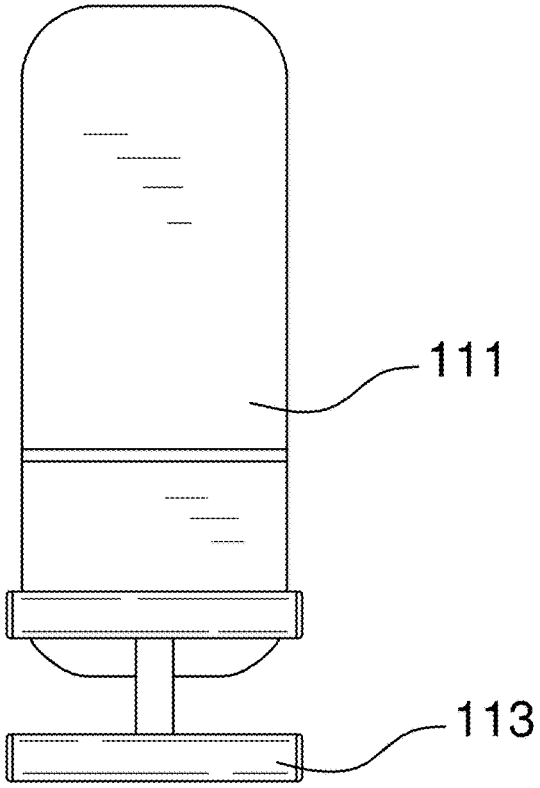
FIG. 2*a* is a top view of an embodiment of the disclosure.
Figure 2B:
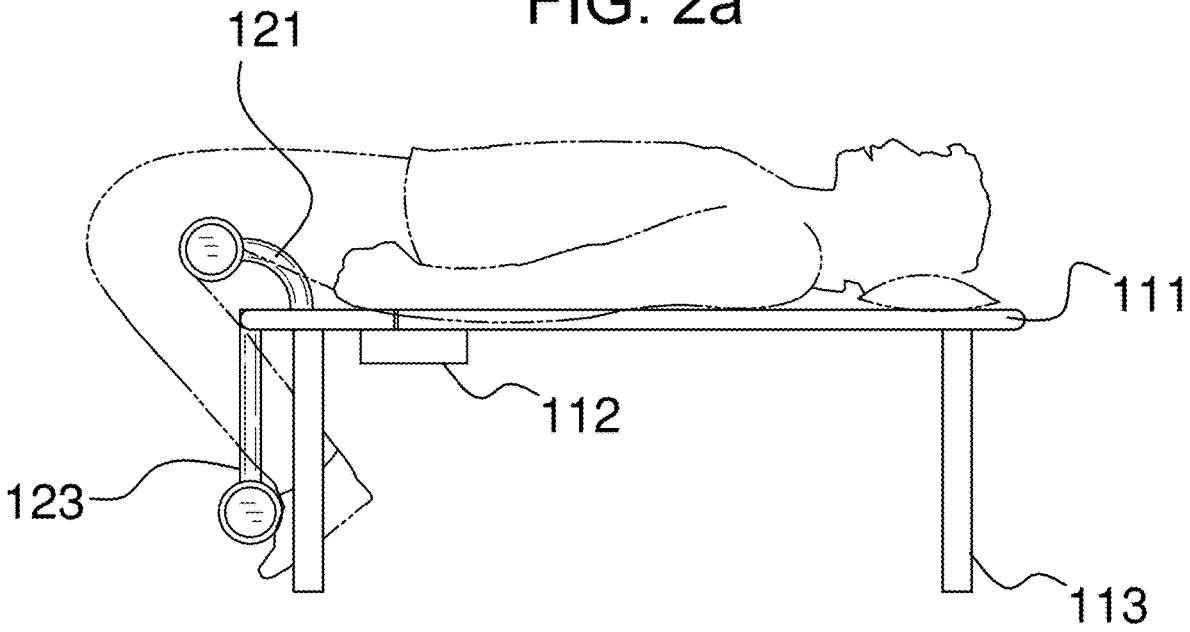
FIG. 2*b* is a side view of an embodiment of the disclosure.
Figure 3:
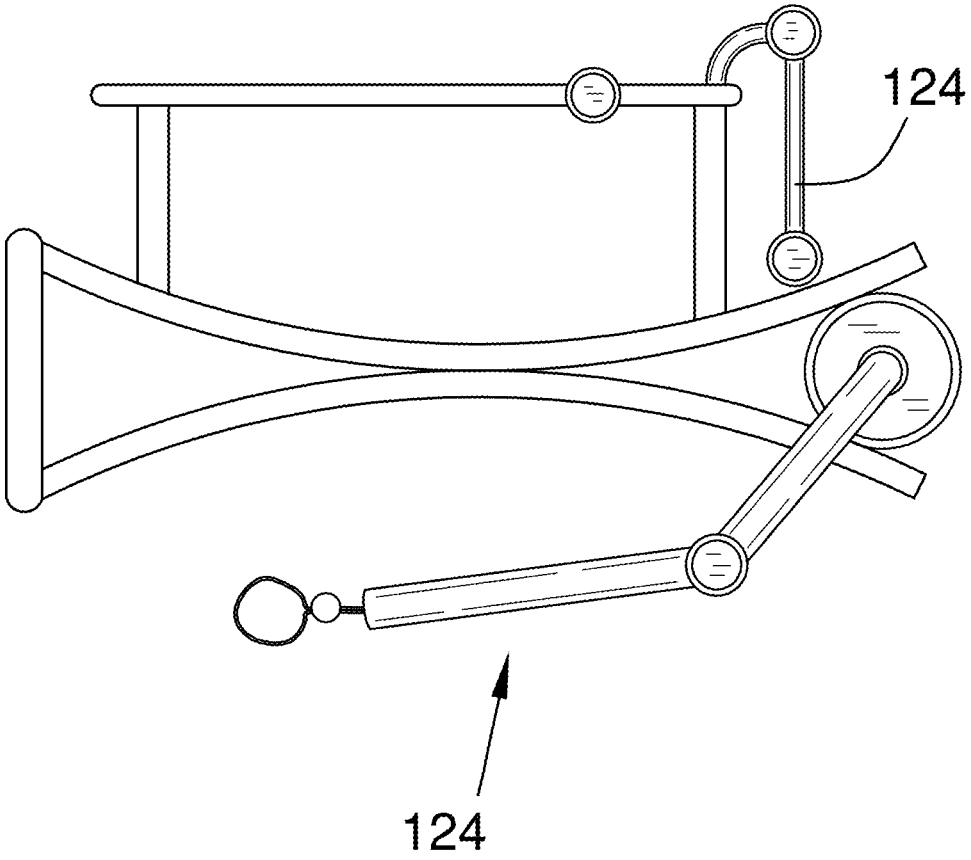
FIG. 3 is a side view of an embodiment of the disclosure.
Figure 4:
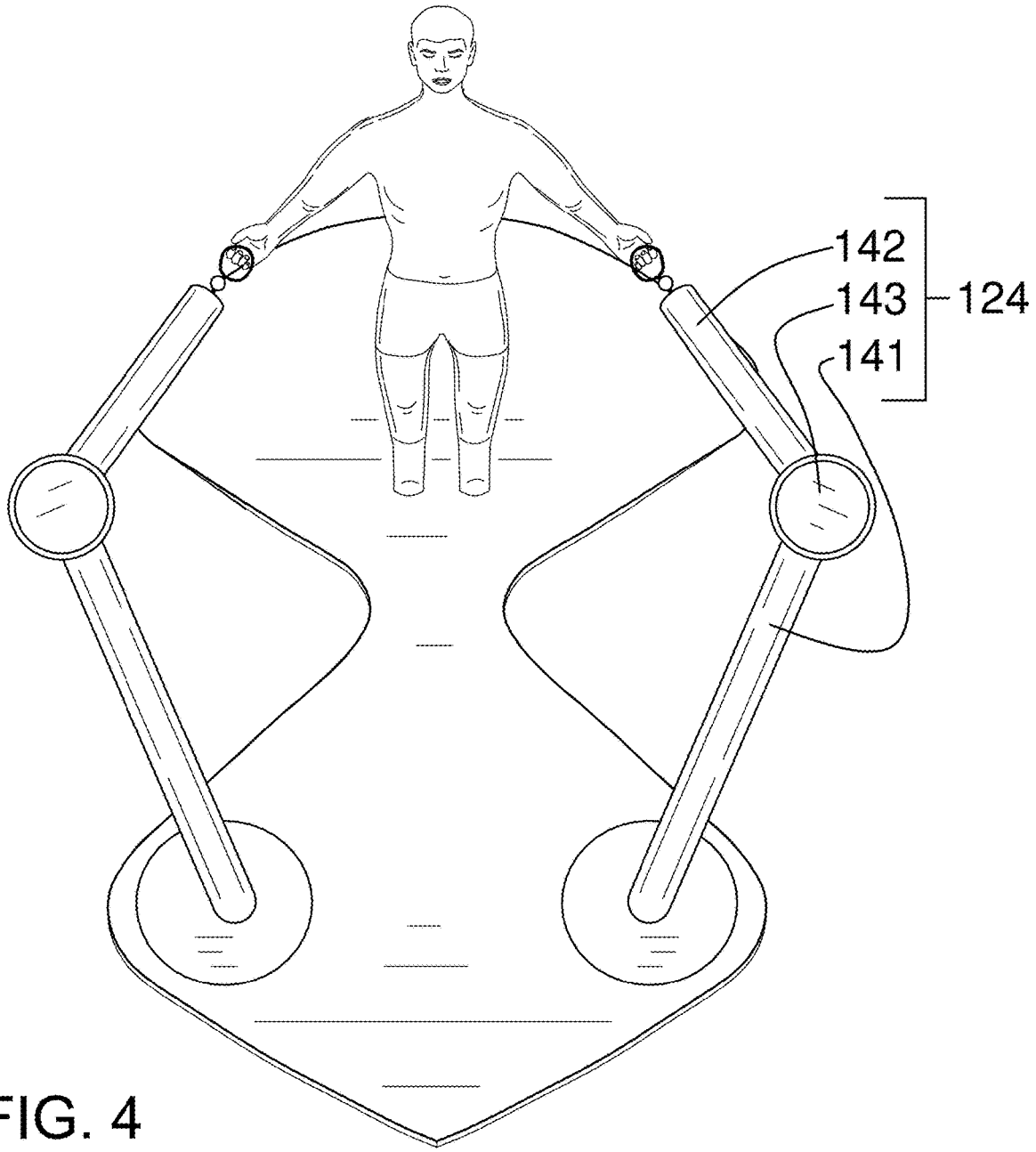
FIG. 4 is a perspective view of an embodiment of the disclosure.
Figure 5:
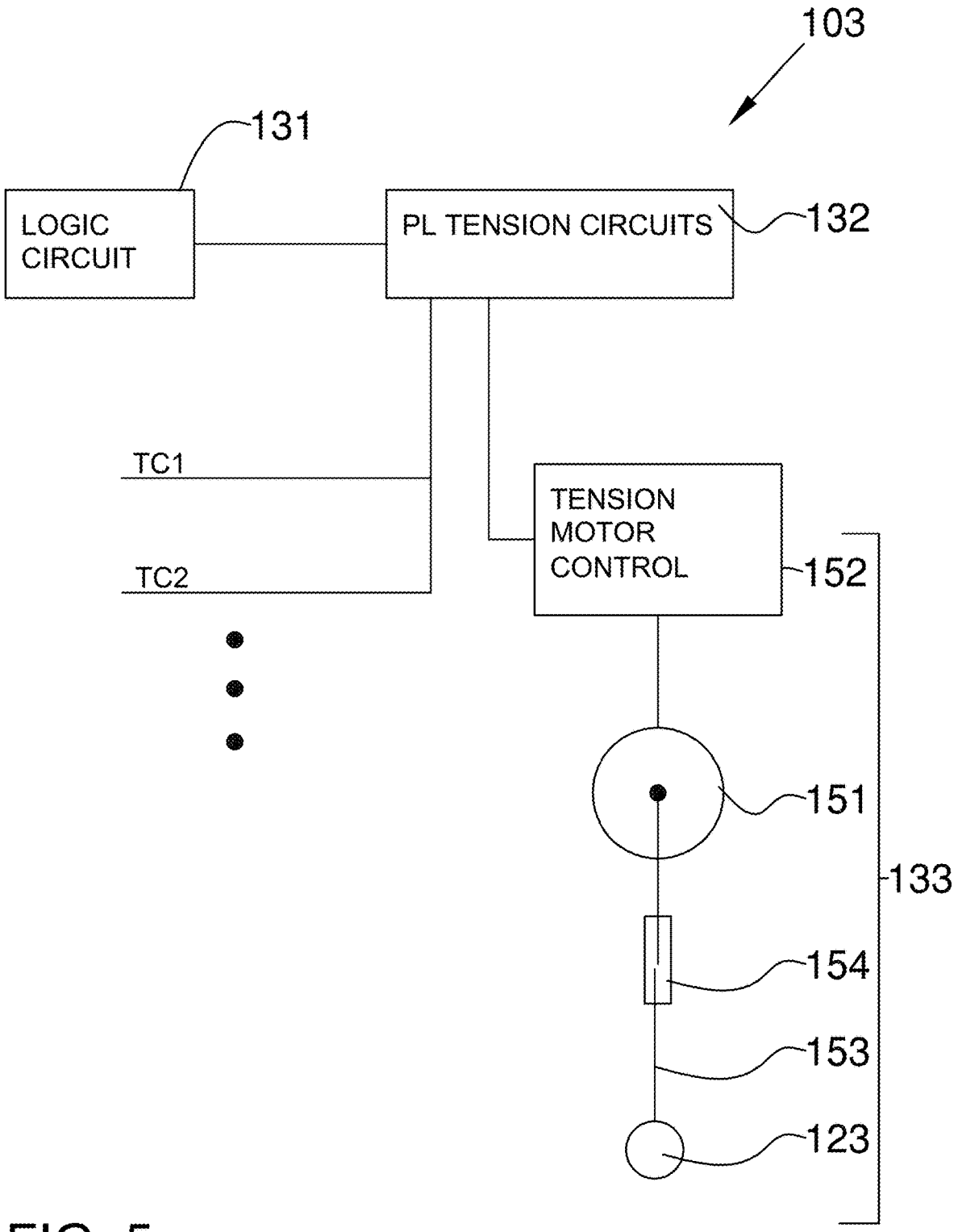
FIG. 5 is a schematic view of an embodiment of the disclosure.

Detailed reference will now be made to one or more potential embodiments of the disclosure, which are illustrated in FIGS. 1 through 5.

The adaptable fitness machine 100 (hereinafter invention) is an exercise device. The invention 100 is configured for use in strength training. The invention 100 is a programable structure. The invention 100 generates the resistance necessary for strength training. The resistance generated by the invention 100 is adjustable. The invention 100 comprises a pedestal structure 101, a plurality of resistance structures 102, and a control circuit 103. The control circuit 103 and the plurality of resistance structures 102 attach to the pedestal structure 101. The pedestal structure 101 is a load bearing structure that transfers the load of the invention 100 to the supporting surface. The plurality of resistance structures 102 provides the resistance generated by the invention 100. The control circuit 103 controls the amount of resistance generated by each individual resistance structure 124 selected from the plurality of resistance structures 102.

The pedestal structure 101 is a rigid structure. The pedestal structure 101 is a load bearing structure. The pedestal structure 101 forms the structure that supports the individual using the invention 100. The pedestal structure 101 forms the structure that transfers the loads of the plurality of resistance structures 102, the pedestal structure 101, and the control circuit 103 to a supporting surface. The pedestal structure 101 comprises a pedestal plate 111 and a control housing 112.

The pedestal plate 111 is a mechanical structure. The pedestal plate 111 is a disk shaped structure. The pedestal plate 111 is a rigid structure. The pedestal plate 111 is a load bearing structure. In the first potential embodiment of the disclosure, the pedestal plate 111 has a rough figure 8 shape. The pedestal plate 111 forms a platform that supports an individual using the invention 100. The plurality of resistance structures 102, the control housing 112, and the platform structure 113 attach to the pedestal plate 111.

The control housing 112 is a rigid structure. The control housing 112 is a hollow structure. The control housing 112 forms a protected space that contains the control circuit 103. The control housing 112 is formed with the form factors and apertures necessary for the operation of the invention 100. The control housing 112 attaches to the pedestal plate 111 using a method selected from the group consisting of: a) mounting on the pedestal plate 111; and, b) mounting in an interior space formed in the pedestal plate 111.

In a second potential embodiment of the disclosure, the pedestal plate 111 further comprises a platform structure 113. The platform structure 113 is a load bearing structure. The platform structure 113 is a scaffolding structure. The platform structure 113 elevates the pedestal plate 111 above a supporting surface. The platform structure 113 elevates the pedestal plate 111 such that the platform structure 113 forms an elevated supporting surface.

The plurality of resistance structures 102 comprises a collection of individual resistance structures 124. Each individual resistance structure 124 selected from the plurality of resistance structures 102 is a mechanical structure. Each selected individual resistance structure 124 is a rigid structure. Each selected individual resistance structure 124 is a load bearing structure. Each selected individual resistance structure 124 is a rotating structure. Each individual resistance structure 124 selected from the plurality of resistance structures 102 forms the structure that guides the motion of a strength training exercise. Each selected individual resistance structure 124 mechanically attaches to the control circuit 103. The control circuit 103 provides each selected individual resistance structure 124 with the physical resistance required for strength training exercises.

Each individual resistance structure 124 selected from the plurality of resistance structures 102 further comprises a fixed arm structure 141, a free arm structure 142, and a joint structure 143.

The fixed arm structure 141 is a prism shaped structure. The fixed arm structure 141 is a rigid structure. A congruent end of the fixed arm structure 141 permanently attaches to the pedestal plate 111 of the pedestal structure 101. The fixed arm structure 141 is a load bearing structure. The fixed arm structure 141 transfers the load of the individual resistance structure 124 to the pedestal plate 111.

The free arm structure 142 is a prism shaped structure. The free arm structure 142 is a rigid structure. The joint structure 143 attaches a congruent end of the free arm structure 142 to the congruent end of the fixed arm structure 141 that is distal from the pedestal plate 111. The joint structure 143 attaches the free arm structure 142 to the fixed arm structure 141 such that the free arm structure 142 rotates relative to the fixed arm structure 141. The free arm structure 142 is a load bearing structure. The joint structure 143 transfers the load of the free arm structure 142 to the fixed arm structure 141. The free arm structure 142 is formed with a grip that mounts on the congruent end of the free arm structure 142 that is distal from the fixed arm structure 141. The exercise resistance generated by the control circuit 103 is provided directly to the exercising individual through the free arm structure 142.

The joint structure 143 is a fastening device. The joint structure 143 is a universal joint. The joint structure 143 forms the structure that joins the free arm structure 142 to the fixed arm structure 141. The joint structure 143 attaches the free arm structure to the fixed arm structure 141 such that the free arm structure 142 rotates relative to the fixed arm structure 141 around at least two axes of rotation. The joint structure 143 is a locking structure. The joint structure 143 locks in a manner that allows the rotation of the free arm structure 142 relative to the fixed arm structure 141 to be limited to a single arc of rotation. The joint structure 143 is designed such that the arc of rotation can be moved to accommodate a plurality of different exercises.

The plurality of resistance structures 102 further comprises a first arm resistance structure 121, a second arm resistance structure 122, and a leg resistance structure 123. The first arm resistance structure 121 is an individual resistance structure 124 selected from the plurality of resistance structures 102. The first arm resistance structure 121 forms an individual resistance structure 124 of the plurality of resistance structures 102 that is intended for use by a first arm of the user. The second arm resistance structure 122 is an individual resistance structure 124 selected from the plurality of resistance structures 102. The second arm resistance structure 122 forms an individual resistance structure 124 of the plurality of resistance structures 102 that is intended for use by a second arm of the user. The leg resistance structure 123 is an individual resistance structure 124 selected from the plurality of resistance structures 102. The leg resistance structure 123 forms an individual resistance structure 124 of the plurality of resistance structures 102 that is intended for use by the legs of the user.

The control circuit 103 is an electromechanical device. The control circuit 103 converts electric energy into mechanical energy that is transmitted to each individual resistance structure 124 selected from the plurality of resistance structures 102. The control circuit 103 mechanically attaches to each selected individual resistance structure 124 with an individual tension cable 153. The control circuit 103 measures the tension applied to the selected individual resistance structure 124 through the individual tension cable 153. The control circuit 103 selects the appropriate tension that should be applied to each individual resistance structure 124 selected from the plurality of resistance structures 102. The control circuit 103 mechanically applies the appropriate tension to each selected individual resistance structure 124 through its associated individual tension cable 153. The control circuit 103 comprises a logic circuit 131 and a plurality of tension circuits 132.

The logic circuit 131 is an electric circuit. The logic circuit 131 electrically connects to each individual tension circuit 133 selected from the plurality of tension circuits 132. The logic circuit 131 controls the operation of each selected individual tension circuit 133. The logic circuit 131 independently determines the desired tension on each individual resistance structure 124 selected from the plurality of resistance structures 102. The logic circuit 131 monitors the tension applied to each selected individual resistance structure 124. The logic circuit 131 identifies any differences between the desired and monitored tensions of the selected individual resistance structure 124. The logic circuit 131 monitors and controls the tension on each selected individual resistance structure 124 by controlling the operation of the individual tension circuit 133 selected from the plurality of tension circuits 132 that is associated with the selected individual resistance structure 124.

The plurality of tension circuits 132 further comprises a collection of individual tension circuits 133. Each individual tension circuit 133 selected from the plurality of tension circuits 132 is an electromechanical device. Each selected individual tension circuit 133 electrically connects to the logic circuit 131. The logic circuit 131 independently controls the operation of each selected individual tension circuit 133.

Each individual tension circuit 133 selected from the plurality of tension circuits 132 is associated with an individual resistance structure 124 selected from the plurality of resistance structures 102. Each selected individual tension circuit 133 controls the tension applied to its associated selected individual resistance structure 124. By controlling the tension is meant that each selected individual tension circuit 133 measures the tension applied to the associated selected individual resistance structure 124. By controlling the tension is further meant that each selected individual tension circuit 133 transmits the measured tension to the logic circuit 131. By controlling the tension is further meant that each selected individual tension circuit 133 receives electric signals from the logic circuit 131 providing the adjustments to the tension required of each selected individual tension circuit 133. By controlling the tension is finally meant that each selected individual tension circuit 133 adjusts the tension provided to the associated selected individual resistance structure 124 to the adjusted tension level.

Each individual tension circuit 133 selected from the plurality of tension circuits 132 mechanically attaches to the joint structure 143 of its associated individual resistance structure 124 selected from the plurality of resistance structures 102. Each selected individual tension circuit 133 measures the tension applied to the associated selected individual resistance structure 124 through the mechanical attachment. Each selected individual tension circuit 133 controls the tension applied to its associated selected individual resistance structure 124 through the mechanical attachment.

Each individual tension circuit 133 selected from the plurality of tension circuits 132 further comprises an individual tension motor 151, an individual motor controller 152, the individual tension cable 153, and the individual tension sensor 154.

The individual tension cable 153 is a cord. An end of the individual tension cable 153 attaches to the individual tension motor 151. The end of the individual tension cable 153 that is distal from the individual tension motor 151 attaches to the joint structure 143. The individual tension motor 151 is an electric motor. The individual tension motor 151 applies a tension to the individual tension cable 153 that inhibits the rotation of the joint structure 143 which in turn inhibits the rotation of the free arm structure 142 relative to the fixed arm structure 141. The amount of force to rotate the free arm structure 142 is a function of the amount of tension applied to the individual tension cable 153 by the individual tension motor 151.

The individual tension sensor 154 is a force sensor. The individual tension sensor 154 is placed in physical contact with the individual tension cable 153 such that the individual tension sensor 154 measures the tension applied to the individual tension cable 153 by the individual tension motor 151. The individual tension sensor 154 electrically connects to the logic circuit 131. The individual tension sensor 154 transmits the measured tension to the logic circuit 131.

The individual motor controller 152 is an electric device. The motor controller is defined elsewhere in this disclosure. The individual motor controller 152 controls the direction of rotation of the individual tension motor 151. The individual motor controller 152 controls the speed of rotation of the individual tension motor 151. The tension applied to the individual tension cable 153 by the individual tension motor 151 is controlled by controlling the speed and direction of rotation of the individual tension motor 151. The individual motor controller 152 electrically connects to the logic circuit 131. The logic circuit 131 calculates the required speed and rotation of the individual tension motor 151 using the measurements taken by the individual tension motor 151. The logic circuit 131 transmits the required speed and rotation of the individual tension motor 151 to the individual motor controller 152 over the electric connect.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Arc: As used in this disclosure, an arc refers to a portion of a circumference or a curved perimeter. When applied to an angle or cant, the arc also refers to a measure of an angular span as measured from an angle formed at the vertex at the center of a circle to the two endpoints of the arc.

Associate: As used in this disclosure, the term associate is used to describe a relationship between a first object and a second object. The use of the term associated implies both: a) that the first object works with the second object in order to accomplish a task necessary for the implementation of the invention (such as joining two objects together); and, b) the relationship remains stable through the accomplishment of the task. By stable is meant that neither the first object or the second object are intended to be interchanged with a third object during the use of the invention.

Barrier: As used in this disclosure, a barrier is a physical obstacle that forms a boundary between a first space and a second space. The barrier prevents the passage of an object between the first space and the second space.

Bearing: As used in this disclosure, a bearing is a mechanical device that: 1) guides and limits the motion of a moving component relative to a fixed component; and, 2) reduces the friction between the moving component and the fixed component. A locking bearing is a bearing that can be locked such that the rotation or movements are secured into a fixed position until the locking bearing is subsequently unlocked.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned.

When the center axes of two cylinder, prism or pyramidal structures do not share the same line they are said to be offset.

Center, Major, Minor, and Thickness Dimensions: As used in this disclosure, the center dimension, the major dimension, the minor dimension, and the thickness each refer to the span of a length associated with a structure selected from the group consisting of a prism structure and a disk structure. The center dimension is the span of the length of the center axis of the selected structure. The thickness is an alternate name given to the center dimension when the selected structure is a disk structure. The major dimension is the span of the length of the major axis of the perimetrical boundary that contains the selected structure. The minor dimension is the span of the length of the minor axis of the perimetrical boundary that contains the selected structure. The terms center dimension, the major dimension, the minor dimension, and the thickness are also used to describe one or more linear axes of direction associated with the selected structure. Always use major and minor axes, perimetrical boundary, and full prism.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Control Circuit: As used in this disclosure, a control circuit is an electrical circuit that manages and regulates the behavior or operation of a device.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord. This definition further includes textile webbings as a type of cord. The free end of a cord refers to the region of the cord that is proximal to the congruent end of the prism shape of the cord. A fixed end of a cord refers to a free end of a cord that has been bound to an anchor point.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Effective Length: As used in this disclosure, the effective length of an object is the span of the distance of an object that is required to perform the function of the object. The effective length is lesser than or equal to the span of the distance of the object. For example, the effective length of a belt is the span of distance of the belt that is used to bind the belt to a prism shaped structure. The effective length of the belt can be less than the actual length of the belt.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Environment: As used in this disclosure, an environment refers to the physical conditions surrounding an object. The term environment is often limited to the physical conditions that the object interacts with.

Exercise: As used in this disclosure, to exercise is a verb that refers to one or more physical activities that cause an individual to exert their muscles and organs such that the performance of the individual in the one or more physical activities will improve over a period of time. Each of the one or more physical activities are referred to as an exercise. Exercises are commonly classified as endurance exercises and strength training exercises. An endurance exercise focuses on improving the stamina and cardiovascular health of the individual. Strength exercises focus on improving the force, power, or work that can be generated from the muscles of the individual. A strength exercise that requires an individual to overcome an opposing force is referred to a resistance based exercise. Strength exercises are commonly classified as isometric exercises and isotonic exercises. An isometric exercise involves a motion that contracts the muscles of the individual without requiring the rotation of a joint of the individual. An isotonic exercise involves a motion that requires the rotation of a joint during the contraction of the muscle of the individual.

Exterior: As used in this disclosure, the exterior is used as a relational term that implies that an object is not contained within the boundary of a structure or a space.

Feedback: As used in this disclosure, feedback refers to a system or subsystem, including engineered systems, further comprising an "input" and an "output" wherein the difference between the output of the engineered system or subsystem and a reference is used as, or fed back into, a portion of the input of the system or subsystem. Examples of feedback in engineered systems include, but are not limited to, a fluid level control device such as those typically used in a toilet tank, a cruise control in an automobile, a fly ball governor, a thermostat, and almost any electronic device that comprises an amplifier. Feedback systems in nature include, but are not limited to, thermal regulation in animals and blood clotting in animals (wherein the platelets involved in blood clotting release chemical to attract other platelets).

Force: As used in this disclosure, a force refers to a net (or unopposed) measurable interaction that changes the direction of motion of an object, the velocity of motion of an object, the momentum of an object, or the stress within an object. The term work refers to a measure of the amount of energy that is transferred through the application of a force over a distance. The term power refers to a measure of the amount of energy that is transferred over a period of time.

Force Sensor: As used in this disclosure, the force sensor is a sensor that generates an electrically measurable signal that is a function of the amount of force applied to the force sensor. The force sensor is often referred to as a pressure sensor. The force sensor commonly measures force using the piezoelectric effect generated by the deformation of a material. A pressure/tension sensor is a force sensor calibrated to measure force per unit area.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Independent: As used in this disclosure, the term independent refers to the relationship between the operation and control of a first device and a second device. The first device and the second device are independent from each other if: a) the operation of the first device is neither impacted nor influenced by the operation of the second device; and, b) the operation of the second device is neither impacted nor influenced by the operation of the first device.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Joint: As used in this disclosure, a joint refers to the attachment of a first structure to a second structure such that the first structure is able to rotate relative to the second structure. A joint can also refer to a structure that joins, and enables the relative rotation of, the first structure and the second structure. A joint that can be locked into position is called a locking joint.

Lateral Prism Structure: As used in this disclosure, a lateral prism structure refers to the juxtaposition of a first lateral face of a first prism structure to a second lateral face of a second prism structure such that: a) the center axes of the first prism and the second prism are parallel; and, b) the congruent ends of the first prism are parallel to the congruent ends of the second prism. The span of the length of the center axes of the first prism and the second prism need not be equal. The form factor of the congruent ends of the first prism and the second prism need not be geometrically similar.

Limited Arc Motor: As used in this disclosure, a limited arc motor is an electric motor that converts externally provided energy into a limited arc rotation.

Limited Arc Rotation: As used in this disclosure, a limited arc rotation refers to the rotation of a structure that: a) has a rotation that allows the reversal of the direction of rotation of the structure; and, b) has a maximum span of arc of rotation of less than 360 degrees.

Lip: As used in this disclosure, a lip refers to the region of the lateral face of a pan or tube structure that abuts the perimeter of the open face of the pan or tube structure. By abutting the perimeter of the open face is meant that the lip forms a brink with the surface that forms the perimeter of the open face. The lip of the interior surface of the pan structure is called the interior lip. The lip of the exterior surface of the pan structure is called the exterior lip. The region of the lateral face of a pan structure that abuts the perimeter of the closed face of the pan structure is called the brink lip.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Logic Circuit: As used in this disclosure, a logic circuit is an electrical device that receives one or more digital or analog inputs and uses those digital or analog inputs to generate one or more digital or analog outputs. This disclosure allows, but does not assume, that the logic circuit is a programmable device.

Major and Minor Axes: As used in this disclosure, the major and minor axes refer to a pair of perpendicular axes that are defined within a structure. The length of the major axis is always greater than or equal to the length of the minor axis. The major axis forms the longest symmetric bifurcation of a structure selected from the group consisting of: a) the structure; or, b) the perimetrical boundary of the structure. The major and minor axes intersect at the center of the structure. The major axis is always parallel or perpendicular to an edge of a rectangular or rectilinear structure.

Motor: As used in this disclosure, a motor refers to the method of transferring energy from an external power source into rotational mechanical energy.

Motor Controller: As used in this disclosure, a motor controller is an electrical device that is used to control the rotational speed, or simply the speed, and the direction of rotation of an electric motor. Motor controllers will generally receive one or more inputs which are used to determine the desired rotational speed and direction of rotation of the electric motor.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

Offset Composite Prism: As used in this disclosure, an offset composite prism structure is a non-Euclidean structure. The shape of the offset composite prism structure is reasonably approximated by a plurality of prism structures. The shape of the offset composite prism structure is formed by joining the congruent end of a first prism structure is joined to the congruent end of a second structure such that the center axis of the first prism structure forms a cant with the center axis of the second prism structure.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction. In a one to one correspondence, the first element of the first set is said to be associated to the second element of the second set to which the first element corresponds.

Pan: As used in this disclosure, a pan is a hollow containment structure. The pan has a shape selected from the group consisting of: a) a prism; and, b) a truncated pyramid. The pan has a single open face. The open face of the pan is often, but not always, the superior face of the pan. The open face is a surface selected from the group consisting of: a) a congruent end of the prism structure that forms the pan; b) a lateral face of the prism structure that forms the pan, c) the base face of the truncated pyramid structure; and, d) the truncated face of the truncated pyramid structure. A semi-enclosed pan refers to a pan wherein the closed end of prism structure of the pan and/or a portion of the lateral face of the pan is also open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object. In a two-dimensional structure, the perimetrical boundary is the rectangle with the minimum surface area.

Pivot: As used in this disclosure, a pivot is a rod or shaft around which an object rotates or swings.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Pulley: As used in this disclosure a pulley is a wheel with a grooved rim around which a cord (or other form of rope, line, or cable) passes. The pulley is used to change the direction of a force applied to the cord.

Rigid Structure: As used in this disclosure, a rigid structure is a solid structure formed from an inelastic material that resists changes in shape. A rigid structure will permanently deform as it fails under a force. See bimodal flexible structure.

Rolling Element Bearing: As used in this disclosure, a rolling element bearing comprises is a type of bearing comprising an inner race, and outer race, and a plurality of ball bearings. The plurality of ball bearings are sphere shaped. The inner race is a circular ring. The outer race is a circular ring with an inner diameter that is greater than the outer diameter of the inner race. The plurality of ball bearings are placed between the inner race and the outer race such that: 1) the inner race and the outer race are coaxially positioned; and, 2) the inner race rotates relative to the outer race. Typically, the inner race attaches to a first object and the outer race attaches to a second object such that the first object rotates relative to the second object. Typically, a rolling element bearing is disk shaped. A rolling element bearing is said to be "locking" when the relative position of the inner race is locked into a fixed position relative to the outer race.

Rotation: As used in this disclosure, rotation refers to the cyclic movement of an object around a fixed point or fixed axis. The verb of rotation is to rotate.

Roughly: As used in this disclosure, roughly refers to a comparison between two objects. Roughly means that the difference between one or more parameters of the two compared objects are not significantly different.

Sensor: As used in this disclosure, a sensor is a device that receives and responds in a predetermined way to a signal or stimulus. As further used in this disclosure, a threshold sensor is a sensor that generates a signal that indicates whether the signal or stimulus is above or below a given threshold for the signal or stimulus.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Tension: As used in this disclosure, tension refers to a force applied to an object such that the force will increase the span of length of the object along the direction of the force.

Tube: As used in this disclosure, the term tube is used to describe a hollow prism-shaped device with two congruent open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Universal Joint: As used in this disclosure, a universal joint is a method of joining a first shaft to as second shaft such that the center axis of the first shaft and is offset from the center axis of the second shaft. The offset angle is adjustable. When a universal joint is formed with a locking mechanism, a universal joint can further be used to lock the offset angle, often referred to as a cant, between the first shaft and the second shaft into a fixed position. Universal joints are often used to transfer rotation from the first shaft to rotate the second shaft.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An adaptable fitness machine comprising
- a pedestal structure, a plurality of resistance structures, and a control circuit;
- wherein the control circuit and the plurality of resistance structures attach to the pedestal structure;
- wherein the adaptable fitness machine is configured for use in strength training;
- wherein the pedestal structure is adapted to support an individual using the adaptable fitness machine;
- wherein each individual resistance structure selected from the plurality of resistance structures further comprises a fixed arm structure, a free arm structure, and a joint structure;
- wherein the control circuit comprises a logic circuit and a plurality of tension circuits;
- wherein each individual tension circuit selected from the plurality of tension circuits further comprises an individual tension motor, and an individual tension cable;
- wherein an end of the individual tension cable attaches to the individual tension motor;
- wherein the individual tension motor applies a tension to the individual tension cable that inhibits a rotation of a joint structure which in turn inhibits the rotation of a free arm structure relative to the fixed arm structure;
- wherein the amount of force to rotate the free arm structure is a function of the amount of tension applied to the individual tension cable by the individual tension motor.

2. The adaptable fitness machine according to claim 1
- wherein the adaptable fitness machine is an exercise device;
- wherein the adaptable fitness machine is a programable structure;
- wherein the adaptable fitness machine generates the resistance necessary for strength training;
- wherein the resistance generated by the adaptable fitness machine is adjustable.

3. The adaptable fitness machine according to claim 2
- wherein the pedestal structure is a load bearing structure that transfers the load of the adaptable fitness machine to a supporting surface;
- wherein the plurality of resistance structures provides the resistance generated by the adaptable fitness machine;
- wherein the control circuit controls the amount of resistance generated by each individual resistance structure selected from the plurality of resistance structures.

4. The adaptable fitness machine according to claim 3
wherein the pedestal structure is a rigid structure;
wherein the pedestal structure is a load bearing structure;
wherein the pedestal structure forms the structure that transfers the loads of the plurality of resistance structures, the pedestal structure, and the control circuit to a supporting surface.

5. The adaptable fitness machine according to claim 4
wherein the plurality of resistance structures comprises a collection of individual resistance structures;
wherein each individual resistance structure selected from the plurality of resistance structures is a mechanical structure;
wherein each selected individual resistance structure is a rigid structure;
wherein each selected individual resistance structure is a load bearing structure;
wherein each selected individual resistance structure is a rotating structure;
wherein each individual resistance structure selected from the plurality of resistance structures forms the structure that guides the motion of a strength training exercise;
wherein each selected individual resistance structure mechanically attaches to the control circuit;
wherein the control circuit provides each selected individual resistance structure with the physical resistance required for strength training exercises.

6. The adaptable fitness machine according to claim 5
wherein the control circuit is an electromechanical device;
wherein the control circuit converts electric energy into mechanical energy that is transmitted to each individual resistance structure selected from the plurality of resistance structures;
wherein the control circuit mechanically attaches to each selected individual resistance structure with an individual tension cable;
wherein the control circuit measures the tension applied to the selected individual resistance structure through the individual tension cable;
wherein the control circuit selects the appropriate tension that should be applied to each individual resistance structure selected from the plurality of resistance structures;
wherein the control circuit mechanically applies the appropriate tension to each selected individual resistance structure through its associated individual tension cable.

7. The adaptable fitness machine according to claim 6
wherein the fixed arm structure is a rigid structure;
wherein a congruent end of the fixed arm structure permanently attaches to a pedestal plate of the pedestal structure;
wherein the fixed arm structure is a load bearing structure;
wherein the fixed arm structure transfers the load of the individual resistance structure to the pedestal plate;
wherein the free arm structure is a rigid structure;
wherein the joint structure attaches a congruent end of the free arm structure to the congruent end of the fixed arm structure that is distal from the pedestal plate;
wherein the joint structure attaches the free arm structure to the fixed arm structure such that the free arm structure rotates relative to the fixed arm structure;
wherein the free arm structure is a load bearing structure;
wherein the joint structure transfers the load of the free arm structure to the fixed arm structure;
wherein the joint structure is a fastening device;
wherein the joint structure is a universal joint;
wherein the joint structure forms the structure that joins the free arm structure to the fixed arm structure;
wherein the joint structure attaches the free arm structure to the fixed arm structure such that the free arm structure rotates relative to the fixed arm structure around at least two axes of rotation;
wherein the joint structure is a locking structure;
wherein the joint structure locks in a manner that allows the rotation of the free arm structure relative to the fixed arm structure to be limited to a single arc of rotation;
wherein the joint structure is designed such that the arc of rotation can be moved to accommodate a plurality of different exercises.

8. The adaptable fitness machine according to claim 7
wherein the logic circuit electrically connects to the plurality of tension circuits.

9. The adaptable fitness machine according to claim 8
wherein the logic circuit is an electric circuit;
wherein the logic circuit electrically connects to each individual tension circuit selected from the plurality of tension circuits;
wherein the logic circuit controls the operation of each selected individual tension circuit;
wherein the logic circuit independently determines the desired tension on each individual resistance structure selected from the plurality of resistance structures;
wherein the logic circuit monitors the tension applied to each selected individual resistance structure;
wherein the logic circuit identifies any differences between the desired and monitored tensions of the selected individual resistance structure;
wherein the logic circuit monitors and controls the tension on each selected individual resistance structure by controlling the operation of the individual tension circuit selected from the plurality of tension circuits that is associated with the selected individual resistance structure.

10. The adaptable fitness machine according to claim 9
wherein the plurality of tension circuits further comprises a collection of individual tension circuits;
wherein each individual tension circuit selected from the plurality of tension circuits is an electromechanical device;
wherein each selected individual tension circuit electrically connects to the logic circuit;
wherein the logic circuit independently controls the operation of each selected individual tension circuit;
wherein each individual tension circuit selected from the plurality of tension circuits is associated with an individual resistance structure selected from the plurality of resistance structures.

11. The adaptable fitness machine according to claim 10
wherein each selected individual tension circuit controls the tension applied to its associated selected individual resistance structure;
wherein by controlling the tension is meant that each selected individual tension circuit measures the tension applied to the associated selected individual resistance structure;
wherein by controlling the tension is further meant that each selected individual tension circuit transmits the measured tension to the logic circuit;
wherein by controlling the tension is further meant that each selected individual tension circuit receives electric signals from the logic circuit providing the adjustments to the tension required of each selected individual tension circuit;

wherein by controlling the tension is finally meant that each selected individual tension circuit adjusts the tension provided to the associated selected individual resistance structure to the adjusted tension level;

wherein each individual tension circuit selected from the plurality of tension circuits mechanically attaches to the joint structure of its associated individual resistance structure selected from the plurality of resistance structures;

wherein each selected individual tension circuit measures the tension applied to the associated selected individual resistance structure through the mechanical attachment;

wherein each selected individual tension circuit controls the tension applied to its associated selected individual resistance structure through the mechanical attachment.

12. The adaptable fitness machine according to claim 11 wherein each individual tension circuit selected from the plurality of tension circuits further further comprises, an individual motor controller, and the individual tension sensor;

wherein the individual tension cable is a cord;

wherein the end of the individual tension cable that is distal from the individual tension motor attaches to the joint structure;

wherein the individual tension motor is an electric motor;

wherein the individual tension sensor is a force sensor;

wherein the individual tension sensor is placed in physical contact with the individual tension cable such that the individual tension sensor measures the tension applied to the individual tension cable by the individual tension motor;

wherein the individual tension sensor electrically connects to the logic circuit;

wherein the individual tension sensor transmits the measured tension to the logic circuit;

wherein the individual motor controller is an electric device;

wherein the individual motor controller controls the direction of rotation of the individual tension motor;

wherein the individual motor controller controls the speed of rotation of the individual tension motor;

wherein the tension applied to the individual tension cable by the individual tension motor is controlled by controlling the speed and direction of rotation of the individual tension motor;

wherein the individual motor controller electrically connects to the logic circuit;

wherein the logic circuit calculates the required speed and rotation of the individual tension motor using the measurements taken by the individual tension motor;

wherein the logic circuit transmits the required speed and rotation of the individual tension motor to the individual motor controller over the electric connection.

13. The adaptable fitness machine according to claim 12 wherein the plurality of resistance structures further comprises a first arm resistance structure, a second arm resistance structure, and a leg resistance structure;

wherein the first arm resistance structure is an individual resistance structure selected from the plurality of resistance structures;

wherein the second arm resistance structure is an individual resistance structure selected from the plurality of resistance structures;

wherein the leg resistance structure is an individual resistance structure selected from the plurality of resistance structures.

14. The adaptable fitness machine according to claim 13 wherein the pedestal structure comprises a pedestal plate and a control housing;

wherein the pedestal plate is a mechanical structure;

wherein the pedestal plate is a disk shaped structure;

wherein the pedestal plate is a rigid structure;

wherein the pedestal plate is a load bearing structure;

wherein the control housing is a rigid structure;

wherein the control housing is a hollow structure;

wherein the control housing forms a protected space that contains the control circuit.

* * * * *